US009242481B2

(12) United States Patent
Cluff et al.

(10) Patent No.: US 9,242,481 B2
(45) Date of Patent: Jan. 26, 2016

(54) METHOD OF APPLYING A CURABLE LIQUID AND APPARATUS FOR PERFORMING THE METHOD

(71) Applicant: OCE-TECHNOLOGIES B.V., Venlo (NL)

(72) Inventors: Garnet M. Cluff, Vancouver (CA); Erik Pedersen, Richmond (CA)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/645,125

(22) Filed: Mar. 11, 2015

(65) Prior Publication Data

US 2015/0183234 A1 Jul. 2, 2015

Related U.S. Application Data

(63) Continuation of application No. PCT/EP2013/068764, filed on Sep. 10, 2013.

(60) Provisional application No. 61/705,953, filed on Sep. 26, 2012.

(30) Foreign Application Priority Data

Dec. 20, 2012 (EP) ..... 12198398

(51) Int. Cl.
*B41J 2/01* (2006.01)
*B41J 11/00* (2006.01)
*B41M 7/00* (2006.01)

(52) U.S. Cl.
CPC ..... *B41J 11/002* (2013.01); *B41J 11/0015* (2013.01); *B41M 7/0045* (2013.01)

(58) Field of Classification Search
CPC ..... B41J 11/002; B41J 2/2114; B41J 11/0015
USPC ..... 347/102, 101
See application file for complete search history.

(56) References Cited

U.S. PATENT DOCUMENTS

| | | | | |
|---|---|---|---|---|
| 6,868,885 | B2 * | 3/2005 | Kakimoto et al. | 156/379 |
| 2005/0190248 | A1 | 9/2005 | Konno et al. | |
| 2007/0017647 | A1 * | 1/2007 | Habik et al. | 162/140 |
| 2007/0097197 | A1 * | 5/2007 | Kremers | 347/102 |
| 2010/0156971 | A1 | 6/2010 | Ikeda et al. | |
| 2012/0062665 | A1 | 3/2012 | Roof et al. | |

FOREIGN PATENT DOCUMENTS

| | | | |
|---|---|---|---|
| EP | 1 905 609 | A2 | 4/2008 |
| EP | 2 540 515 | A1 | 1/2013 |
| WO | WO 2004/072378 | A1 | 8/2004 |

* cited by examiner

*Primary Examiner* — Henok Legesse
(74) *Attorney, Agent, or Firm* — Birch, Stewart, Kolasch & Birch, LLP

(57) ABSTRACT

In a method for applying a curable liquid using an inkjet printing method, a gloss level is controlled by first applying a first layer of liquid and curing the first layer. Having thus obtained a layer having known properties, a second layer is applied on the first layer. Droplets of the second layer are uncured for a predetermined period of time allowing the droplets to spread and coalesce to form a layer having a smooth and flat surface such to provide a desired gloss level, in particular a high gloss. Further, a printing apparatus configured to perform the method is provided.

14 Claims, 4 Drawing Sheets

Fig. 1A
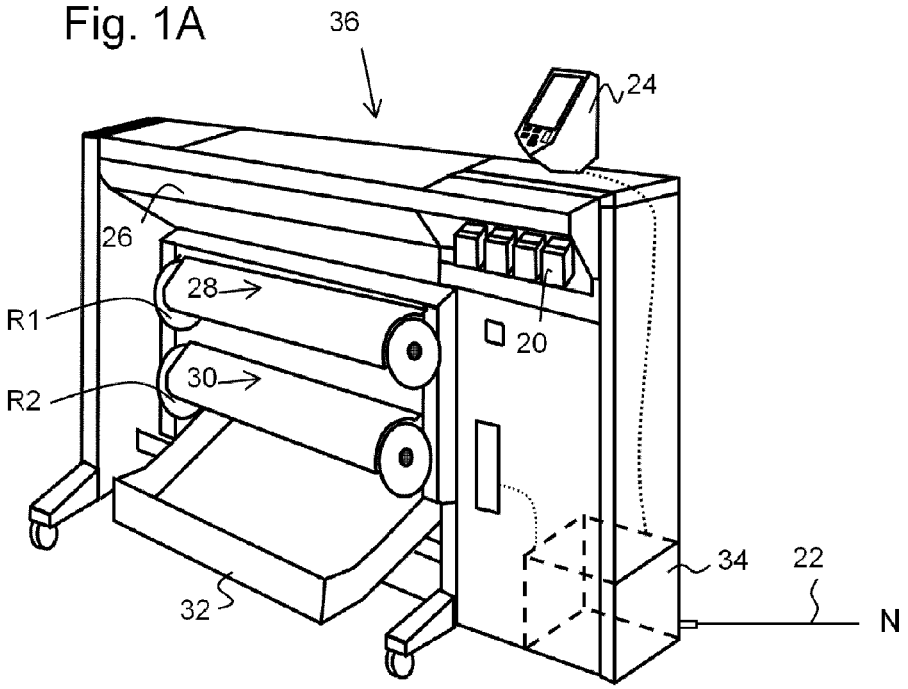
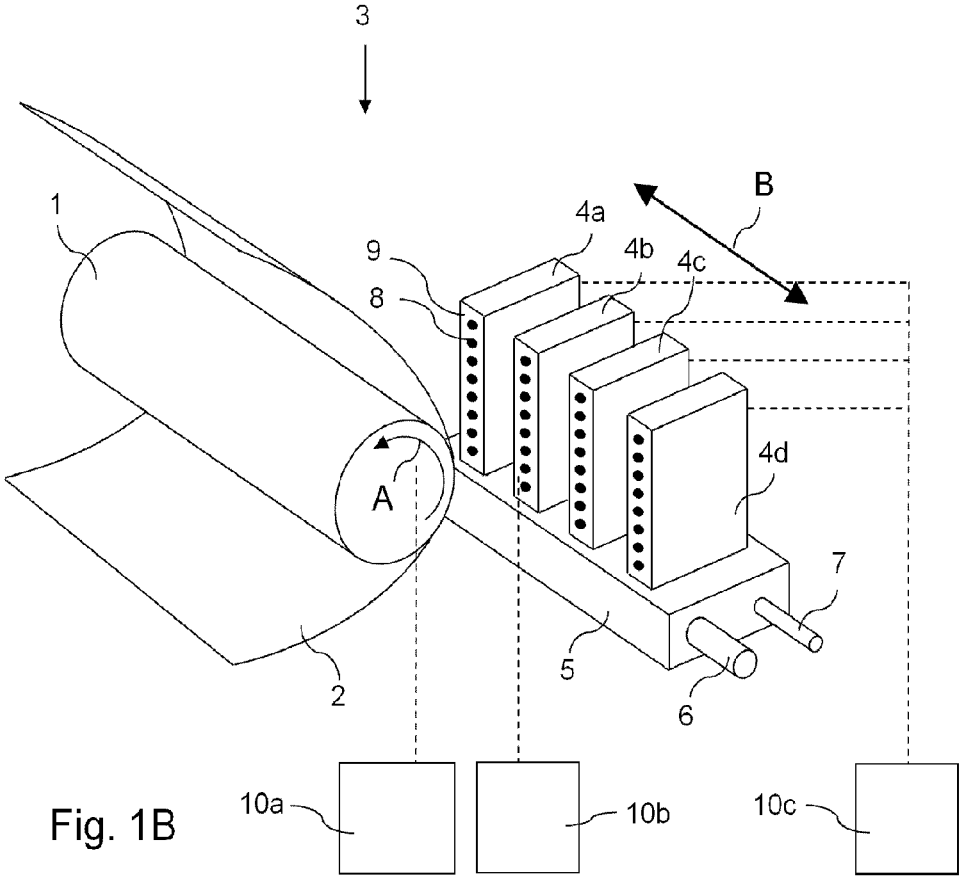
Fig. 1B

METHOD OF APPLYING A CURABLE LIQUID AND APPARATUS FOR PERFORMING THE METHOD

CROSS REFERENCE TO RELATED APPLICATIONS

This application is a Continuation of PCT/EP2013/068764, filed on Sep. 10, 2013, which claims priority under 35 U.S.C. §119(e) to U.S. Provisional Application No. 61/705,953, filed on Sep. 26, 2012, and under 35 U.S.C. §119(a) to application Ser. No. 12/198,398.5, filed in Europe on Dec. 20, 2012, all of which are hereby expressly incorporated by reference into the present application.

FIELD OF THE INVENTION

The present invention generally pertains to a method of applying a glossy layer of a curable recording liquid using an inkjet printing technique. The present invention further pertains to an inkjet printing apparatus configured to perform the method according to the present invention.

BACKGROUND ART

It is known to use inkjet printing technology to apply droplets of a recording liquid such as an ink image-wise on a recording medium to form an image on the recording medium. Such recording medium may be paper or may be any other suitable recording medium.

For certain applications, the recording medium may be such that common inks such as water-based inks are not suited and it is well known to use for such applications curable inks, in particular curable by irradiation of a suitable radiation. A commonly used radiation for curing is UV-radiation.

The curable recording liquids are applied in droplets by ejection from an inkjet print head and stay in a liquid-phase after application on the recording medium. The droplets may spread and even coalesce with neighboring droplets, depending on the particular properties of the recording liquid and/or recording medium, while they are in such liquid phase. After a predetermined period of time after application, the droplets are cured by irradiation of a suitable radiation. The irradiation may be controlled based on an amount of radiation per unit of time and a duration of irradiation, thus by controlling a total dose of radiation. After curing the recording liquid adheres to the recording medium and has solidified.

A disadvantage of the known method of application is that the resulting gloss level (i.e. a high gloss, low gloss or matt finish) depends on the properties of the recording medium and/or the properties of the recoding liquid and/or other properties such as printing parameters, including but not limited to a recording liquid temperature at the time of application. Controlling such properties and related control parameters to obtain a controlled gloss level is difficult and even unpredictable, requiring trial and error to obtain a desired gloss level. Such trial and error is of course undesirable.

Moreover, the recording liquid may be a translucent or transparent recording liquid, such as a varnish. Such recording liquid may be applied with the intention to generate a high gloss. Using such recording liquid, it is desirable that the resulting gloss level is independent from the recording medium.

SUMMARY OF THE INVENTION

In an aspect of the present invention, a method of applying a recording liquid is provided. The method according to the present invention provides a gloss level that is independent from the recording medium used. The present invention further provides for an inkjet printing apparatus configured to perform the method according to the present invention.

In the method according to the present invention, the recording liquid is first applied in a first layer of droplets. The first layer substantially completely covers a predetermined part of the recording medium. After a first period of time, the first layer of recording liquid is cured, thereby forming a substantially closed layer of cured recording liquid on the recording medium. The gloss level of the first layer is irrelevant to the present invention. The gloss level may be a high gloss or may be a matt finish. It is intended that the first layer covers the recording medium, thereby rendering the recording medium properties irrelevant for a second layer of the recording liquid. Thus, the first layer is to provide for a recording surface having known properties, irrespective of the recording medium.

After curing the first layer, a second layer of recording liquid is applied over (at least a part of) the cured first layer. The second layer is left uncured for a second period of time allowing the recording liquid to spread and coalesce to form a layer having a smooth and therefore glossy surface. As the properties of the recording liquid and the properties of the cured first layer are known a priori, the gloss level is also known a priori and may even be selected by controlling the second period of time. After spreading and coalescing, the second layer is cured.

In order to cover the recording medium, only a thin first layer is needed, while for sufficient spreading and coalescing, larger droplets of recoding liquid are desired. Therefore, in an embodiment, the droplets applied for providing the first layer have a first and the droplets applied for providing the second layer have a second size, wherein the second size is larger than the first size.

In an embodiment, the first period of time is shorter than the second period of time. The first layer is intended to generate a sealing layer such to prevent an interaction between the recording medium and the second layer of recording liquid. However, the first layer may be laid down on the recording medium and may thus interact with the recording medium. With many, if not most, kinds of recording mediums, an ink laid on the recording medium will be absorbed into the medium and the sealing function will be lost. It is noted that this kind of interaction is one of the reasons to desire a sealing layer for obtaining a gloss finish: for a gloss finish, leveling of the applied recording liquid is needed which requires a sufficient amount of time, while in such an amount of time, the recording liquid may be absorbed resulting in a loss of gloss. In order to seal the recording medium, the first layer of recording liquid may be cured shortly after being applied such that at the moment of curing the recording liquid is still present on top of the recording medium. Depending on the recording medium properties, the recording liquid may not have leveled, resulting in a matt finish. However, the second layer will not interact with the medium and will be provided with a longer period of time, i.e. the second period of time, to level before being cured.

In a practical embodiment, the method is performed by an inkjet printing apparatus. The inkjet printing apparatus comprises a carriage. The carriage and the recording medium are moveable with respect to each other in a scanning direction. An inkjet print head for applying droplets of the recording liquid is arranged on the carriage. A radiation source for generating radiation for curing the recording liquid is also arranged on the carriage. The radiation source is arranged on the carriage relative to the inkjet print head downstream in the scanning direction. The inkjet printing apparatus performs the method steps for applying and curing the first layer by moving the carriage and the recording medium relative to each other in the scanning direction, while applying droplets of the recording liquid and while generating the radiation for curing the droplets applied. Thus, in a single relative movement, the droplets for forming the first layer are applied and cured.

In an embodiment of the method according to the present invention, the recording liquid is applied in a number of swaths, each swath extending in a first direction. Each swath has a leading edge and has a trailing edge, the leading edge and the trailing edge extending in the first direction. The method steps of applying and curing the second layer comprise applying a first swath of recording liquid. The first swath is virtually divided in a first sub-swath and a second sub-swath, wherein the first sub-swath includes the leading edge and the second sub-swath includes the trailing edge. Then, after application, including spreading and coalescing, the first sub-swath is pre-cured, leaving the second sub-swath uncured.

Pre-curing as used herein is to be understood as 'not fully curing', for example using a limited dose of radiation instead of a full dose of radiation, at least providing a non-sticking surface. The pre-curing is intended to prevent pollution, by dust particles and the like, adhering to the second layer, while the second layer is not yet fully cured and is still being applied. In order to prevent gloss banding due to the swaths being applied subsequently, the second sub-swath is left uncured.

Subsequently, a second swath is applied. The second swath is virtually divided in a third sub-swath and a fourth sub-swath. The third sub-swath includes the leading edge of the second swath and the fourth sub-swath includes the trailing edge of the second swath. The leading edge of the second swath is arranged adjacent to the trailing edge of the first swath. Thus, the second swath is arranged adjacent to the uncured second sub-swath, allowing coalescence of the droplets of the third sub-swath and the second sub-swath. After such spreading and coalescence, the second sub-swath and the third sub-swath are pre-cured. If no further swath is to be printed adjacent to the fourth sub-swath, the fourth sub-swath may as well be pre-cured, otherwise the method continues with printing a further swath in accordance with the method steps performed for printing the second swath. After all swaths have been applied and pre-cured, the second layer of (pre-cured) recording liquid is fully cured.

In an embodiment, the recording liquid is a translucent or transparent varnish. In an embodiment, such varnish may be applied over an image previously applied on the recording medium. Please note that the method according to the present invention is (also) suitable for preventing differences in appearance between the varnish applied directly on the recording medium and the varnish applied on the image, although the recording medium properties may have changed at the location where the image has been applied.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 1A is a perspective view of an embodiment of a wide-format image forming apparatus;

FIG. 1B is a schematic representation of a printing apparatus used in the image forming apparatus of FIG. 1A;

DETAILED DESCRIPTION OF THE DRAWINGS

Figure 1C:
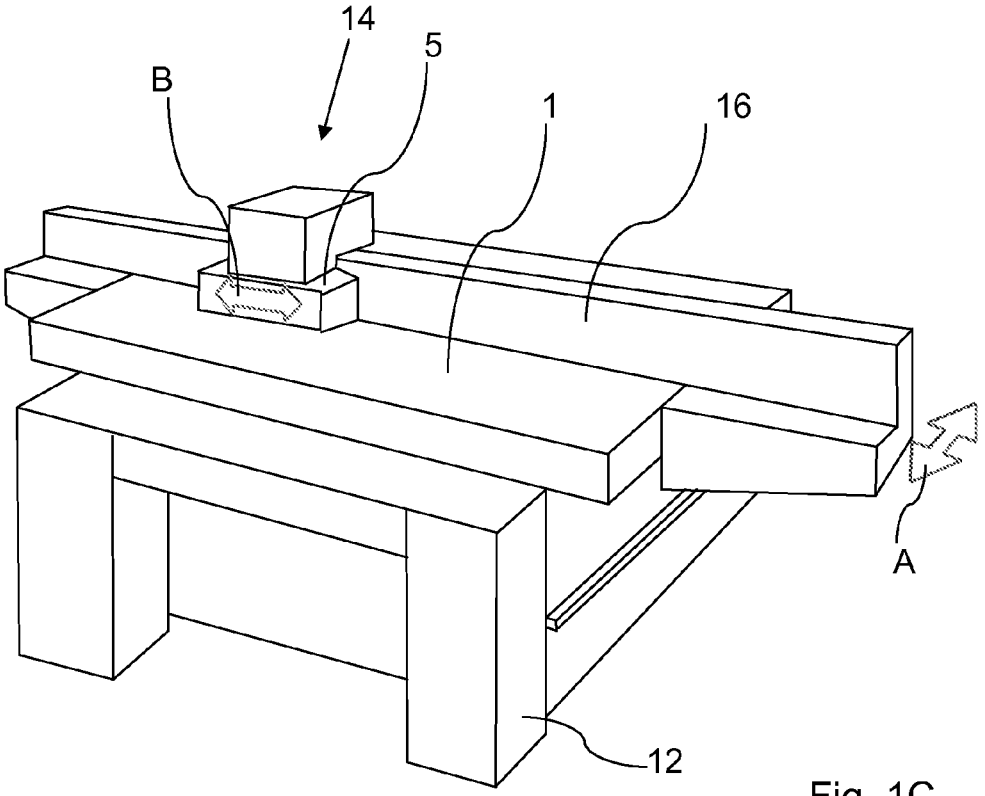
FIG. 1C is a perspective view of another embodiment of a wide-format image forming apparatus.

The present invention will now be described with reference to the accompanying drawings, wherein the same reference numerals have been used to identify the same or similar elements throughout the several views.

FIG. 1A shows an image forming apparatus 36, including a printing apparatus, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing recording medium 28, 30, a delivery station to collect the recording medium 28, 30 after printing and storage means for recording liquid 20. In FIG. 1A, the delivery station is embodied as a delivery tray 32. Optionally, the delivery station may comprise processing means for processing the recording medium 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a recording medium, for example paper, supplied by a roll 28, 30. The roll 28 is supported on the roll support R1, while the roll 30 is supported on the roll support R2. Alternatively, cut sheet recording media may be used instead of rolls 28, 30 of recording medium. Printed sheets of the recording medium, cut off from the roll 28, 30, are deposited in the delivery tray 32.

Each one of the recording liquids for use in the printing assembly are stored in four containers 20 arranged in fluid connection with the respective print heads for supplying recording liquid to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting a recording medium 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the recording medium in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of recording liquid onto the recording medium 2. The platen 1, the carriage 5 and the print heads 4*a*-4*d* are controlled by suitable controlling means 10*a*, 10*b* and 10*c*, respectively.

The recording medium 2 may be a medium in web or in sheet form and may be composed of e.g. paper, cardboard, label stock, coated paper, plastic or textile. Alternatively, the recording medium 2 may also be an intermediate member, endless or not. Examples of endless members, which may be moved cyclically, are a belt or a drum. The recording medium 2 is moved in the sub-scanning direction A by the platen 1 along four print heads 4*a*-4*d* provided with a fluid recording liquid.

A scanning print carriage 5 carries the four print heads 4*a*-4*d* and may be moved in reciprocation in the main scanning direction B parallel to the platen 1, such as to enable scanning of the recording medium 2 in the main scanning direction B. Only four print heads 4*a*-4*d* are depicted for demonstrating the invention. In practice an arbitrary number of print heads may be employed. In any case, at least one print head 4*a*-4*d* per color of recording liquid is placed on the scanning print carriage 5. For example, for a black-and-white printer, at least one print head 4*a*-4*d*, usually containing black recording liquid is present. Alternatively, a black-and-white printer may comprise a white recording liquid, which is to be applied on a black recording medium 2. For a full-color printer, containing multiple colors, at least one print head 4*a*-4*d* for each of the colors, usually black, cyan, magenta and yellow is present. Often, in a full-color printer, black recording liquid is used more frequently in comparison to differently colored recording liquid. Therefore, more print heads 4*a*-4*d* containing black recording liquid may be provided on the scanning print carriage 5 compared to print heads 4*a*-4*d* containing recording liquid in any of the other colors. Alternatively, the print head 4*a*-4*d* containing black recording liquid may be larger than any of the print heads 4*a*-4*d*, containing a differently colored recording liquid.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the recording medium 2 in the main scanning direction B.

Each print head 4*a*-4*d* comprises an orifice surface 9 having at least one orifice 8, in fluid communication with a pressure chamber containing fluid recording liquid provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of recording liquid from the orifices 8.

Upon ejection of the recording liquid, some recording liquid may be spilled and stay on the orifice surface 9 of the print head 4*a*-4*d*. The ink present on the orifice surface 9, may negatively influence the ejection of droplets and the placement of these droplets on the recording medium 2. Therefore, it may be advantageous to remove excess of ink from the orifice surface 9. The excess of ink may be removed for example by wiping with a wiper and/or by application of a suitable anti-wetting property of the surface, e.g. provided by a coating.

FIG. 10 shows a flatbed printing apparatus 14 having a flat platen 1 for supporting a recording medium thereon. The flat platen 1 may be provided with suction holes operatively coupled to a vacuum pump for holding the recording medium on the platen 1 by generating an under-pressure, as is well known in the art. A gantry 16 provides a guide means for guiding the carriage 5 in the main scanning direction B. The gantry 16 is moveable in a sub-scanning direction A. Thus, the carriage 5 is moveable in both main scanning direction B and the sub-scanning direction A, thereby being enabled to print at any location on the flat platen 1. The platen 1 and the gantry 16, including carriage 5 and any print heads arranged thereon, as described hereinafter, are supported on a support structure 12.

A number of inkjet print heads (not shown) are arranged on the carriage 5 and are configured to provide droplets of a recording liquid on a medium arranged on the platen 1. Commonly, the carriage 5 is moved along the gantry 16 in the main scanning direction B for providing a swath of droplets, after which the gantry 16 is moved in the sub-scanning direction A over a predetermined distance after which a subsequent stroke of the carriage 5 along the gantry 16 is performed. The predetermined distance may be equal to a width of the swath or may be smaller to enable multi-pass printing to provide a higher density of droplets, as is well known in the art.

The inkjet printing assembly 3 and/or the flatbed printing apparatus 14 may use a curable recording liquid, for example an UV-curable recording liquid which may be cured by irradiation with UV radiation. The liquid may be ejected at room temperature, or may be heated to an elevated temperature, as known in the art. In particular, it is known that UV-curable ink compositions may be ejected at a temperature in the range from about 40° C. to about 80° C. However, any other suitable temperature may be used as well depending on the recording liquid properties and/or recording medium properties.

If such curable recording liquid is employed, the carriage 5 may also be provided with a curing means for curing the recording liquid after it has been applied on the recording medium. For example, if the recording liquid is curable by UV radiation, the carriage 5 may be provided with a UV radiation source, such as a suitable UV lamp. In particular, the radiation source may be arranged—in the scanning direction—downstream of the print heads. If the printing assembly 3 and/or the printing apparatus 14 print bi-directional, there may be radiation sources arranged on both sides of the print heads to enable curing in both directions.

Figure 2A:
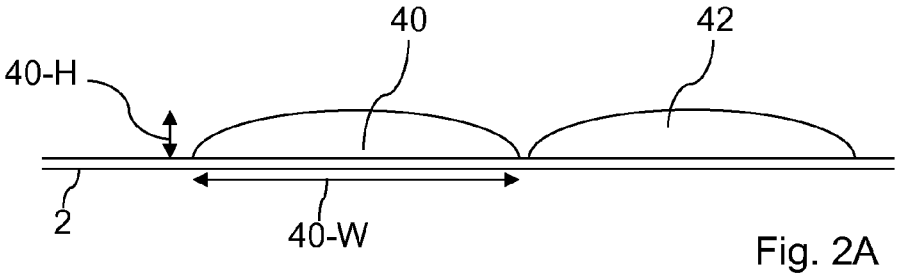
FIG. 2A is a schematic drawing illustrating droplets applied on a recording medium.

FIG. 2A shows a first droplet 40 and a second droplet 42 applied on a recording medium 2. The first and second droplet 40, 42 are applied by an inkjet print head and are made of a curable liquid. Upon impact on the recording medium 2 and depending on the properties of the liquid and the properties of the recording medium 2, the first and second droplets 40, 42 spread over the recording medium 2 until an equilibrium state of all relevant physical forces is obtained. Such physical forces include surface tension, viscosity, wettability and the like. These physical forces thus determine the resulting size and shape of the droplets. In FIG. 2A, the first droplet 40 has a width 40-W and a height 40-H. Further depending on a printing resolution and droplet positioning, the first and second droplets 40, 42 may remain separate dots on the recording medium 2, as illustrated in FIG. 2A. If and when the first and second droplet 40, 42 would be cured in the illustrated state, a matt finish would result due to the shape of the upper surface.

Figure 2B:
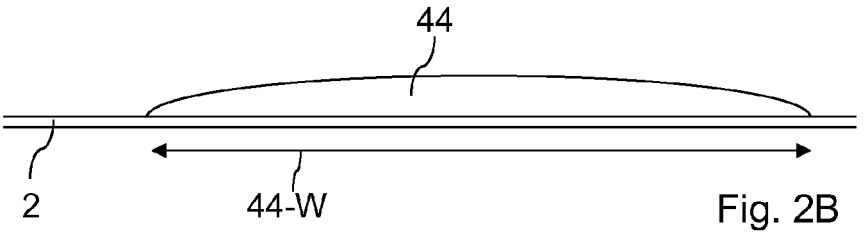
FIG. 2B is a schematic drawing illustrating coalesced droplets applied on a recording medium.

If a high gloss finish would be desired, a flat and smooth upper surface is needed. Hence, more spreading and even coalescing of neighboring droplets would be preferred. In FIG. 2B, a large droplet 44 has formed from two droplets, for example from the first and the second droplet 40, 42. The first and second droplet 40, 42 have spread more, thereby increasing the width 40-W such that the droplets 40, 42 contacted and coalesced into the single droplet 44. Due to the coalescence and spreading, the upper surface has become more flat and smooth and, correspondingly, a more glossy finish results.

In order to obtain a glossy finish, the spreading and coalescing of droplets is important. However, the properties of the recording medium 2 and the interaction between the liquid and the recording medium 2 determine the actual spreading after application. Therefore, in the prior art, it has been difficult to control the resulting gloss level independent from the recording medium 2 used.

Figure 3A:
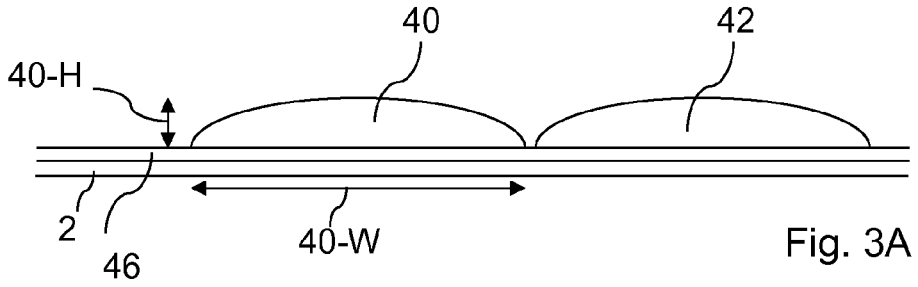
FIG. 3A is a schematic drawing illustrating droplets applied on a first layer of droplets in accordance with the present invention.
Figure 3B:
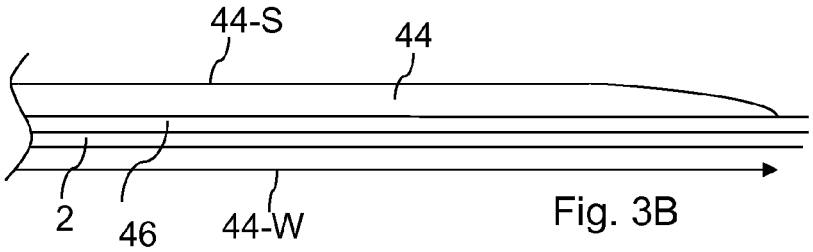
FIG. 3B is a schematic drawing illustrating coalesced droplets applied on a first layer of droplets in accordance with the present invention.

In accordance with the present invention and as shown in FIGS. 3A and 3B, such influence of the recording medium type may be rendered irrelevant by first applying a first layer of liquid and curing such layer, irrespective of its gloss level, but covering the recording medium 2. Thus, a cured first layer 46 is provided on the recording medium 2. Then, with reference to FIG. 3A, a second layer may be provided by applying the first and the second droplet 40, 42, the width 40-W and the height 40-H are now determined by the properties of the liquid of the first and second droplet 40, 42 and the properties of the cured first layer 46, which properties are a priori known, as it has been provided earlier. Hence, the printing process and spreading and coalescence may have been controlled and selected such that a desired upper surface shape results. So, if desired a matt finish may be obtained as shown in FIG. 3A, or a high gloss finish may be obtained as shown in FIG. 3B, in which it is shown that the first and second droplets 40, 42 have coalesced and spread extensively such that a substantially flat and smooth upper surface 44-S is obtained.

Figures 4A, 4B, 4C:
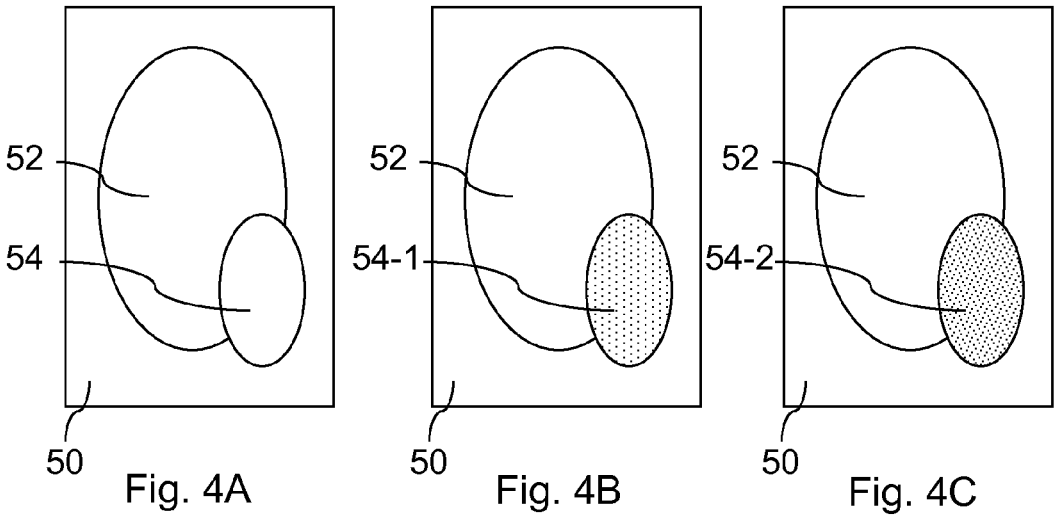
FIG. 4A-4C illustrate a method of applying a varnish layer only on a part of a previously provided image.

In an embodiment, the liquid is a transparent or at least translucent liquid, such as varnish. Using varnish enables to selectively add gloss to an image. As shown in FIG. 4A, a recording medium 50 has been provided with an image consisting of a first image part 52 and a second image part 54. The image may have been provided with the same printing apparatus or may have been provided using another printing apparatus and may be formed by a similar ink, such as a UV-curable ink, or any other suitable ink, like a water-based ink or the like. It is now presumed that it is intended to add gloss to the second image part 54.

To provide gloss to the second image part 54, in accordance with the present invention, a first layer of varnish is applied to the second image part 54, as shown in FIG. 4B. For example, small droplets of varnish are applied and as soon as possible cured using a scanning printing apparatus such as illustrated in FIG. 1C having a number of print heads on the carriage and a curing means arranged downstream of the print heads. Thus, a relatively thin cured first layer 54-1 is provided only on top of the second image part 54.

After having provided the relatively thin cured first layer 54-1 a second layer of varnish is applied on top of the relatively thin cured first layer 54-1. The second layer is provided by applying larger droplets containing more liquid, thereby spreading more and coalescing more. Curing is not performed until the applied droplets have sufficiently spread and coalesced to a desired level. Then, the second layer is also cured, thereby providing a relatively thick cured second layer 54-2, as shown in FIG. 4C. Thus, a desired gloss level of the second image part 54 is obtained.

FIGS. 5A-5E illustrate an embodiment of the present invention, in which swaths of the liquid, e.g. varnish, are applied adjacent to each other such to form a single layer. In this embodiment it is provided that a smooth gloss is obtained without artifacts due to the swaths having been applied separately. In FIGS. 5A-5D, it is illustrated that the varnish is applied over a large part of the recording medium 50, but the method as elucidated in FIG. 5E may as well be employed for performing the method illustrated in FIGS. 4A-4C. In any case, in the description relating to FIGS. 5A-5E, it is presumed that a first layer of cured varnish has been applied previously and FIGS. 5A-5E and the description elucidate a method for applying the second layer in accordance with the present invention. However, if desired or needed, the first layer may of course be applied similarly.

Figure 5A:
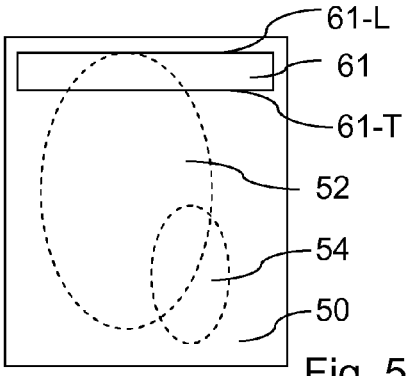
FIG. 5A-5D illustrate an embodiment of a method of applying a varnish layer over a recording medium.

FIG. 5A shows a recording medium 50 having an image provided thereon comprising a first image part 52 and a second image part 54 (cf. FIG. 4A). Further, a first swath 61 of varnish is shown. The first swath may have been applied in accordance with first and second method steps S1 and S2 (FIG. 5E) by an inkjet print head by a single stroke in the scanning direction, but the first swath may as well be formed by multiple strokes over the same area of the recording medium 50 for providing a higher resolution (known in the art as a multi-pass print strategy) and/or by multiple strokes positioned next to each other to provide a stroke having a larger height.

The first swath 61 has a leading edge 61-L and a trailing edge 61-T. The leading edge 61-L and the trailing edge 61-T extend in a direction in which the first swath 61 extends.

Figure 5B:
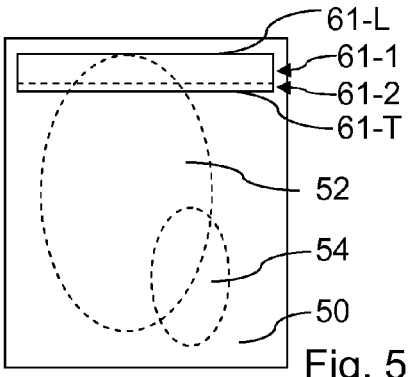

As illustrated in FIG. 5B and in accordance with the second method step S2, the first swath 61 is virtually divided in a first sub-swath 61-1 and a second sub-swath 61-2. The first sub-swath 61-1 includes the leading edge 61-L and the second sub-swath 61-2 includes the trailing edge 61-T.

When the droplets of the first swath 61 have sufficiently spread and coalesced, i.e. to a desired extent and/or after a predetermined period of time, as a third method step S3 (FIG. 5E), the first sub-swath 61-1 is pre-cured to at least provide a non-sticking surface of the varnish. Such non-sticking surface prevents adherence of dust and dirt particles to the surface, for example. The layer of varnish is however not fully cured such that the first sub-swath 61-1 remains relatively flexible and undesired tension in the layer is prevented. The second sub-swath 61-2 is not cured, allowing coalescence and mingling with varnish to be applied in a second swath 62.

Figure 5C:
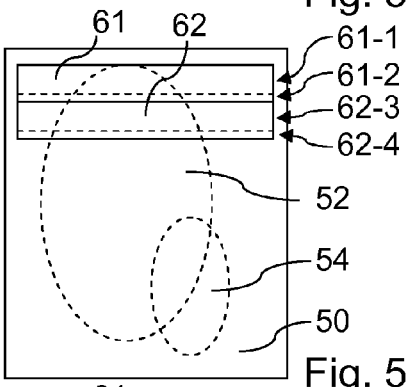
Figure 5D:
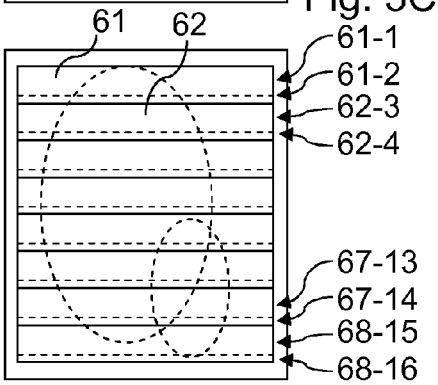
Figure 5E:
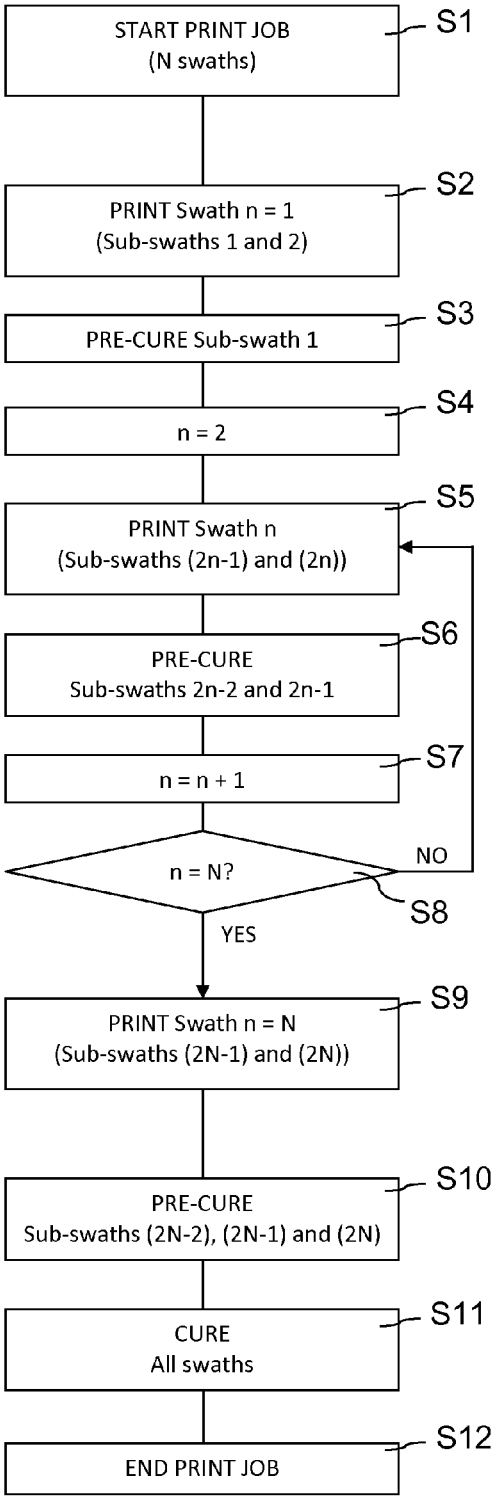
FIG. 5E is a flow diagram further illustrating the embodiment of the method of FIGS. 5A-5D.

In a fourth method step S4, the method is continued by preparing for printing a second swath (n=2), if such a second swath is needed, and the method proceeds to a fifth method step S5, which includes printing such second swath 62, virtually including a third sub-swath 62-3 and a fourth sub-swath 62-4, as illustrated in FIG. 5C. After application of the second swath 62, the second sub-swath 61-2 and the third sub-swath 62-3 are pre-cured (FIG. 5E: a sixth method step S6), leaving the fourth sub-swath 62-4 uncured, since another swath may be applied adjacent to the fourth sub-swath 62-4.

Then, the method continues by preparing for printing a further swath (FIG. 5E: a seventh method step S7: n=n+1), if such a further swath is needed, and in an eighth method step S8 it is verified whether a subsequent swath is a last swath (n=N?). If the subsequent swath is not the last swath (eighth step S8: n=N?: NO), the fifth, sixth, seventh and eighth method steps are repeated, until the subsequent swath is the last swath.

In the example of FIGS. 5A-5D, N is 8. So the fifth, sixth, seventh and eighth method steps S5-S8 are repeated until seven swaths 61-67 have been applied. These seven swaths include fourteen sub-swaths 61-1-67-14, of which thirteen sub-swaths 61-1-67-13 are pre-cured before the method proceeds to applying an eighth swath 68.

If the subsequent swath is the last swath (eighth step S8: n=N?: YES), the method proceeds to a ninth method step S9, in which the eighth swath 68 is to be applied. In the subsequent tenth method step S10, not only the fourteenth sub-swath 67-14 and the fifteenth sub-swath 68-15 are pre-cured, but also the last, sixteenth sub-swath 68-16 is procured, since no further adjacent swath is to be applied.

After the tenth method step S10, a layer of varnish is provided over the recording medium 50, which layer of varnish is pre-cured and therefore still relatively flexible and due to the method of application and curing provides a smooth surface, not showing any banding due to the swath-based application of the layer. Then, in an eleventh method step S11, the whole layer of varnish is cured to a desired extent, for example by providing a predetermined dose of curing radiation at every location of the layer. After curing, the print job completed (indicated as a twelfth method step S12).

Of course, the embodiment illustrated in FIGS. 5A-5E may be adapted without a significant influence on the result. For example, while it is described that a swath is virtually divided in at least two sub-swaths, the method may as well be performed by first applying two swaths, then curing a first swath, then applying a third swath, then curing the second swath, and so on. Also other embodiments and adaptation are contemplated and lie within the ambit of the skilled person to be suitably selected depending on the print job, any print requirements and/or other features and properties.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of applying a layer of a recording liquid on a recording medium by application of droplets of the recording liquid using an inkjet printing technique, which recording liquid is curable, the method comprising:

a. applying a first layer of droplets of the recording liquid on the recording medium such that the first layer covers a predetermined part of the recording medium;

b. selecting a first period of time depending on a time needed for the recording liquid to spread on the recording medium to form the first layer of recording liquid;

c. curing the droplets of the first layer within the first period of time after application;

d. applying a second layer of droplets of the recording liquid on the cured first layer;

e. selecting a second period of time depending on a time needed for the droplets of the recording liquid to spread and coalesce for the second layer to have a smooth and glossy surface;

f. leaving the second layer uncured for the second period of time after application; and g. curing the second layer after the second period of time.

2. The method according to claim 1, wherein the droplets for forming the first layer have a first size and the droplets for forming the second layer have a second size, the second size being larger than the first size.

3. The method according to claim 1, wherein the recording liquid is curable by irradiation with a suitable radiation.

4. The method according to claim 3, wherein the method is performed by an inkjet printing apparatus, the inkjet printing apparatus comprising i. a carriage, the carriage and the recording medium are moveable with respect to each other in a scanning direction;

ii. an inkjet print head arranged on the carriage, iii. a radiation source arranged on the carriage for generating the radiation, the radiation source being arranged relative to the inkjet print head downstream in the scanning direction, wherein steps a-c of the method comprise a1. moving the carriage and the recording medium relative to each other in the scanning direction, a2. applying droplets of the recording liquid, while performing step a1; and a3. generating the radiation, while performing step a1, for curing the droplets applied in step a2.

5. The method according to claim 3, wherein the radiation is a UV radiation.

6. The method according to claim 1, wherein the recording liquid is applied in a number of swaths, each swath extending in a first direction, having a leading edge and having a trailing edge, the leading edge and the trailing edge extending in the first direction and wherein steps d-g comprise the steps of d1. applying a first swath of recording liquid, the first swath comprising a first sub-swath and a second sub-swath, the first sub-swath including the leading edge of the first swath and the second sub-swath including the trailing edge of the first swath;

d2. pre-curing the first sub-swath, leaving the second sub-swath uncured;

d3. applying a second swath, the second swath comprising a third sub-swath and a fourth sub-swath, the third sub-swath including the leading edge of the second swath and the fourth sub-swath including the trailing edge of the second swath, the leading edge of the second swath being arranged adjacent to the trailing edge of the first swath;

d4. pre-curing the second sub-swath and the third sub-swath; and d5. curing the recording liquid applied and pre-cured in the preceding steps d1-d4.

7. The method according to claim 1, wherein the recording liquid is a translucent varnish.

8. The method according to claim 7, wherein prior to performing the method steps a-g, an image is formed on the recording medium and the translucent varnish is applied over the image.

9. The method according to claim 1, wherein the recording liquid is a transparent varnish.

10. The method according to claim 1, wherein the first period of time is different from the second period of time.

11. An inkjet printing apparatus comprising an inkjet print head arranged for applying a recording liquid on a recording medium and comprising a curing means for curing the recording liquid, the inkjet printing apparatus being configured to a. apply a first layer of droplets of the recording liquid on the recording medium such that the first layer covers a predetermined part of the recording medium;

b. select a first period of time depending on a time needed for the recording liquid to spread on the recording medium to form the first layer of recording liquid;

c. cure the droplets of the first layer within the first period of time after application;

d. apply a second layer of droplets of the recording liquid on the cured first layer;

e. select a second period of time depending on a time needed for the droplets of the recording liquid to spread and coalesce for the second layer to have a smooth and glossy surface;

f. leave the second layer uncured for the second period of time after application; and g. cure the second layer after the second period of time.

12. The inkjet printing apparatus according to claim 11, wherein the recording liquid is curable by irradiation with a radiation;

the inkjet printing apparatus further comprises a carriage, the carriage and the recording medium being moveable with respect to each other in a scanning direction and the inkjet print head being arranged on the carriage; and the curing means comprises a radiation source arranged on the carriage for generating the suitable radiation, the radiation source being arranged relative to the inkjet print head downstream in the scanning direction;

the inkjet printing apparatus being configured to a1. move the carriage and the recording medium relative to each other in the scanning direction, a2. apply droplets of the recording liquid, while performing step a1; and a3. generate the radiation, while performing step a1, for curing the droplets applied in step a2.

13. The inkjet printing apparatus according to claim 12, wherein the radiation is a UV radiation.

14. The inkjet printing apparatus according to claim 11, wherein the first period of time is different from the second period of time.

* * * * *